United States Patent [19]

Ogawa

[11] Patent Number: 4,592,739

[45] Date of Patent: Jun. 3, 1986

[54] WEB MATERIAL FOLDING DEVICE

[75] Inventor: Kenji Ogawa, Musashino, Japan

[73] Assignee: Idemitsu Petrochemical Co., Ltd., Tokyo, Japan

[21] Appl. No.: 456,228

[22] Filed: Jan. 7, 1983

[30] Foreign Application Priority Data

Jan. 20, 1982 [JP] Japan ..... 57-7125
Jan. 25, 1982 [JP] Japan ..... 57-9788

[51] Int. Cl.[4] ..... B31B 27/14; B31B 27/26

[52] U.S. Cl. ..... 493/415; 493/194; 493/204; 493/198; 100/34

[58] Field of Search ..... 493/194, 414, 415, 413, 493/430, 448, 204, 198; 100/34

[56] References Cited

U.S. PATENT DOCUMENTS

| | | | |
|---|---|---|---|
| 786,942 | 4/1905 | Averbeck | 409/328 |
| 2,572,289 | 10/1951 | Truslow et al. | 493/414 |
| 3,195,883 | 7/1965 | Southwell et al. | 493/415 |
| 3,233,527 | 2/1966 | Membrino | 493/204 |
| 3,431,828 | 3/1969 | Crawford et al. | 493/204 |
| 3,495,819 | 2/1970 | Davidson | 493/413 |
| 3,498,214 | 3/1970 | Bailey | 100/34 |
| 3,533,331 | 10/1970 | Kugler | 493/194 |
| 3,627,306 | 12/1971 | Affupper | 493/413 |
| 4,045,012 | 8/1977 | Jakob | 493/415 |
| 4,216,705 | 8/1980 | Achelpohl et al. | 493/194 |

FOREIGN PATENT DOCUMENTS

| | | |
|---|---|---|
| 54-49327 | 1/1979 | Japan . |
| 57-96948 | 6/1982 | Japan . |
| 57-107364 | 7/1982 | Japan . |
| 57-137264 | 8/1982 | Japan . |
| 57-142872 | 9/1982 | Japan . |
| 57-151206 | 9/1982 | Japan . |
| 57-151335 | 9/1982 | Japan . |
| 58-312862 | 2/1983 | Japan . |
| 58-99372 | 6/1983 | Japan . |

*Primary Examiner*—Francis S. Husar
*Assistant Examiner*—William E. Terrell
*Attorney, Agent, or Firm*—Flynn, Thiel, Boutell & Tanis

[57] ABSTRACT

A folding device for folding a web material made of plastics or the like to a predetermined length in a Z-shaped manner. In this device, a web material is guided around folded end holding members, which are suitably, linearly movable to and from respective folding end positions of the web material, by means of a feed mechanism for feeding the web material while the feed mechanism reciprocates between both folded end positions, so that the web material can be folded in a Z-shaped manner.

15 Claims, 29 Drawing Figures

WEB MATERIAL FOLDING DEVICE

BACKGROUND OF THE INVENTION

1. Field of the Invention

This invention relates to a web material folding device wherein a web material made of a plastics film or the like is folded by a predetermined length into a Z-shaped manner.

2. Description of the Prior Art

Recently, plastics bags have been used in large quantities as packaging materials because of being sanitary and suitable for mass production at low cost. Furthermore, there has been proposed that a continuous material of the above-described plastics bags (hereinafter referred to as a "plastics continuous bag-shaped material" or simply as a "continuous bag-shaped material") is folded into a Z-shaped manner, housed in a cardboard box and the plastics bag can be taken out as necessary in the same manner as in the pop-up take-out method of tissue paper, one bag after another (Japanese Patent Kokai "Laid-Open" Nos. 96948/82, 142872/82, U.S. patent application Ser. No. 315,815 and Japanese Patent Application No. 194004/81).

Now, as a device for folding the aforesaid plastics continuous bag-shaped material into a Z-shaped manner, there has been proposed such a device wherein there are used two cylindrical rolls each provided on the peripheral surface thereof with an attracting surface within a predetermined angle and the continuous bag-shaped material is alternately folded by means of the attracting surfaces of these two rolls (Japanese Utility Model Kokai "Laid-Open" No. 49327/79). However, this proposal is disadvantageous in that the folding operation is low in reliability. Furthermore, to obviate the above disadvantage, there has been proposed to provide two prismatic attracting members each having two attracting surfaces in such a manner that these attracting surfaces are opposed to each other, whereby these two attracting surfaces are caused to fall toward the opposed ones, to thereby effect the folding operation (Japanese Patent Kokai "Laid-Open" No. 107364/82). However, the latter device as well as the former device using the rolls are adapted to effect the folding operation by use of the vacuum attraction and the release therefrom, and hence, the proposals are disadvantageous in that an installation of a vacuum pump, etc. is required, the devices are rendered large-sized and expensive in cost, and further, not suitable for high folding speed.

In view of the above problems, as a device capable of reliably and efficiently folding a web material without needing to use a large-sized apparatus such as a vacuum pump, there has been proposed a device wherein the web material is alternately guided around the forward end edges of a pair of thin plates alternately reciprocating toward a folded end portion in the longitudinal direction of the web material to thereby fold the web material (Japanese Patent Application No. 128496/81). However, in the thus proposed device, operations of the thin plates contacting the web material are so frequent that the web material tends to be damaged, and further, a stabilized folding operation at high speed cannot be expected to a satisfactory extent.

Further, there have been proposed various stackers in each of which the web material, which has been folded by a folding machine, is reliably piled up and supported (Japanese Utility Model Kokai "Laid-Open" No. 151206/82, Patent Kokai "Laid-Open" Nos. 137264/82 and 151335/82, and Patent Application No. 128496/81). However, each of the proposed stackers is constructed such that a receiving bed on which the folded web material is piled up is pressed down to be gradually depressed as the quantity of the folded web material increases. With this arrangement, sections of the folded web material piled up on the receiving bed are pressed down and closely adhered to one another, thus presenting the disadvantages that wrinkles tend to occur and the subsequent handling of the web material becomes not necessarily easy. Further, it has been difficult to take out a predetermined number of sections of the folded web material during folding operation, and moreover, also difficult to automate the processes from an operation of folding the web material to an operation of packaging the folded web material. Furthermore, the receiving bed is constructed to be pressed downwardly with the increase in the quantity of the folded web material. Consequently, an additional force is applied to the web material folded and piled up in a large quantity on the receiving bed, thus presenting the disadvantage that, when a large quantity of the folded web material is stacked on the receiving bed, the piling of the folded web material may collapse.

SUMMARY OF THE INVENTION

A first object of the present invention is to provide a web material folding device capable of folding a web material reliably and at high speed with no possibility of damaging the web material.

A second object of the present invention is to provide a web material folding device provided with a stacking mechanism capable of stably piling up and supporting the web material thus folded in a state where sections of the folded material are not pressed against and adhered to one another.

To achieve the first object, the present invention contemplates that the device comprises: a web material feed mechanism for feeding a web material, performing reciprocating operations between positions of the folded ends of the web material in the longitudinal direction of the web material; and folded end holding members linearly movable to and from a folded end position at least from one side in the widthwise direction of the web material, of the respective folded end positions of the web material; whereby the web material fed from the feed mechanism is alternately guided around the folded end holding members provided at the folded end positions respectively, and, when the folded end holding members are removed from the folded end portion of the web material, the folding members are retracted substantially in the widthwise direction of the web material, so that the frequency of contact between the holding members and the web material can be decreased during the folding operation.

To achieve the second object, the present invention contemplates that the aforesaid stacker is provided with a receiving bed capable of gradually, automatically descending as the folded web material is gradually piled up and the folding operation progresses while a receiving bed moving mechanism is engaged.

DETAILED DESCRIPTION OF THE PREFERRED EMBODIMENTS

Description will hereunder be given of one embodiment of the present invention with reference to the drawings.

Figure 1:
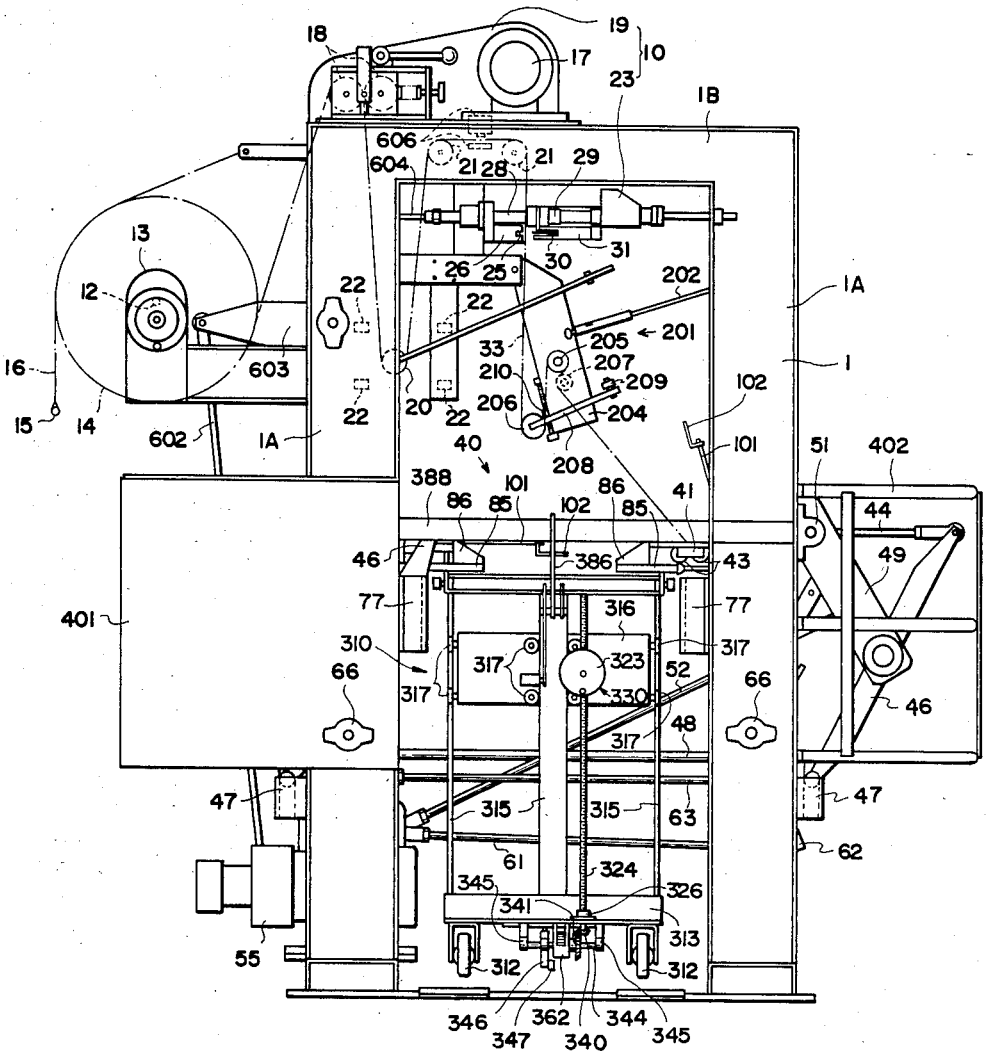
FIG. 1 is a front view showing the general arrangement of one embodiment of the web material folding device according to the present invention.
Figure 2:
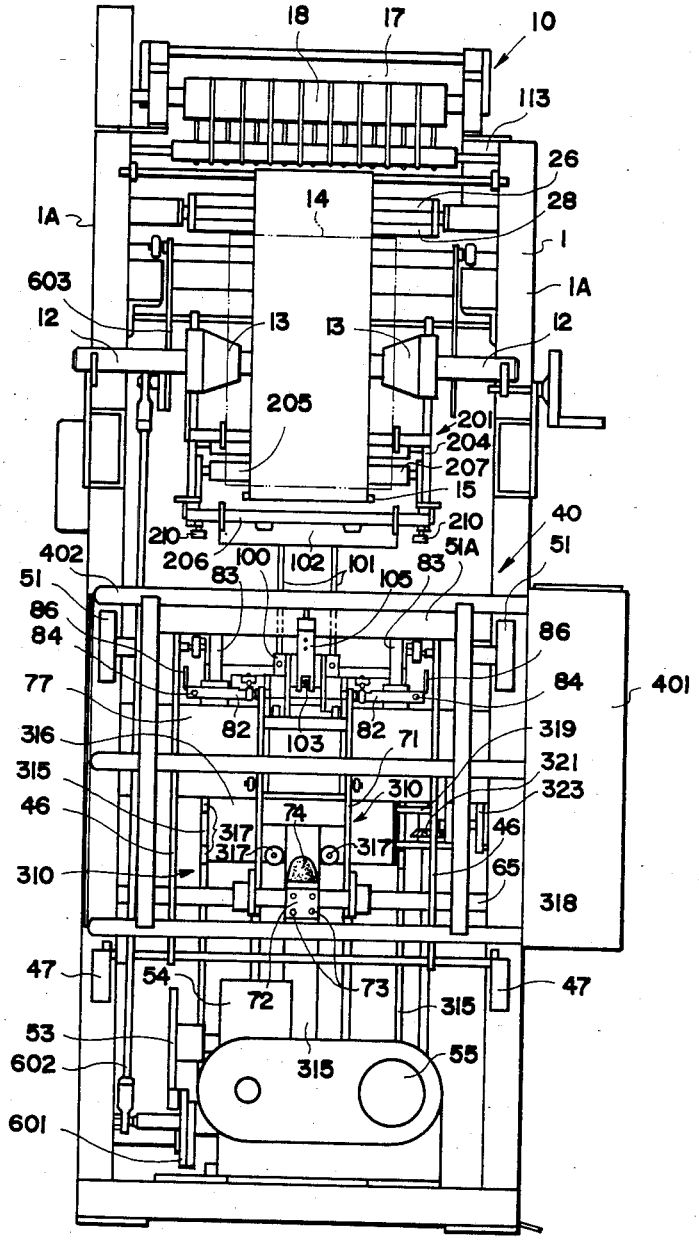
FIG. 2 is a left side view of FIG. 1.

Referring to FIGS. 1 and 2 in which the general arrangement is shown, a main frame 1 formed by the combination of H steels and the like comprises a columnar portion 1A and a beam portion 1B. A bag making machine 10 is provided on the beam portion 1B and a folding machine 40 is assembled into the main frame 1. Rotatably supported by the main frame 1 on the left side of FIG. 1 is a raw web material support shaft 12. Two truncated cone-shaped supported members 13 (Refer to FIG. 2) are solidly secured to the support shaft 12 in such a manner that the smaller-diameter portions of the support members 13 are opposed to each other and spaced a predetermined distance apart from each other in the axial direction thereof. A plastic web material 14 in a rolled state is interposed between these support members 13. This web material 14 is formed of a cylindrical plastics film produced by a tubular film process, which is pressed down to be flat in the axial direction thereof. Guided around the upper portion of the outer periphery of this web material 14 is an over-rotation preventing member 16, such as a flexible plate member solidly secured at one end thereof to the main frame 1 and having fixed to the other end thereof a weight 15.

A plastic web material delivery mechanism 19, including a motor 17 and a pair of drive rolls 18 driven by this motor 17, is provided on the top surface of the beam portion 1B of the main frame 1. The plastic web material 14, which has been delivered by this delivery mechanism 19, passes around a suspended roll 20 displaceable in the vertical direction and two guide rolls 21. Two sets of optical detectors 22, each including a light source and a photoelectric tube, are provided on the main frame 1, are spaced a predetermined distance apart from each other at locations adjacent opposite sides of a portion of the web material 14 suspended therebetween by means of the suspended roll 20. The motor 17 in the delivery mechanism 19 is controlled in response to signals from these detectors 22. More specifically, when the suspended roll 20 is detected to be present upwardly of the upper detector 22, the motor 17 is driven. When the suspended roll 20 is present downwardly of the lower detector 22, the motor 17 is stopped. Thus, the suspended roll 20 is always positioned between the upper and lower sets of detectors 22.

Furthermore, a marking mechanism 606 is provided between the two guide rolls 21, and markings by hot stamping or seal applying are applied as necessary to the surface of the web material 14 passing around the both guide rolls 21 at a rate of a unit length of the web material 14 corresponding to 50, 100 or more folded sections of bags to be formed later on in the device.

A seal mechanism 23, constituting a bag making machine 14 in cooperation with the delivery mechanism 19, is provided on the main frame 1 at a position opposed to the plastic web material 14 following the second one of the two guide rolls 21.

The seal mechanism 23 comprises: a receiving block 26 having a slit 25 therein; a slide shaft 28 linearly movable to and from the receiving block 26; a seal heater 29 mounted onto this slide shaft 28, capable of abutting against the surface of the receiving block 26 above the slit 25 and heat welding the web material 14 over the total width thereof in the lateral direction; a cutter 30 secured to the slide shaft 28, insertable at the forward end thereof into the slit 25 of the receiving block 26, capable of forming two cuts (Refer to FIG. 3) each having a predetermined width in the web material 14 in the widthwise direction thereof and forming a perforated line over the total width of the web material 14 also in the widthwise direction thereof; and a retainer member 31 secured thereto with this cutter 30, having a U-shaped side surface formed therein with a groove opposed to the slit 25 of the receiving block 26, and capable of retaining the web material 14 located at opposite sides of the cutter 30 in cooperation with the receiving block 26 to make easy and reliable the forming work of the perforated line by the cutter 30, when the retainer member 31 abuts against the receiving block 26.

The web material 14, which has been sealed, i.e., heat-welded and formed therein with perforated lines and the like by means of the seal mechanism 23 of the bag making machine 10 defines a continuous strip of bag-shaped material 33.

Figure 3:
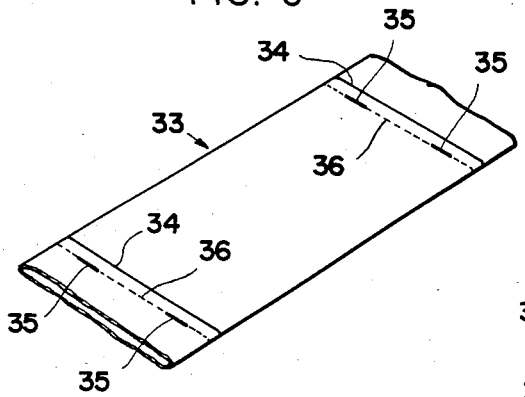
FIG. 3 is a perspective view showing one example of a continuous strip of web material which has been made into bags by a bag making machine section in the above-described embodiment.
Figure 4:
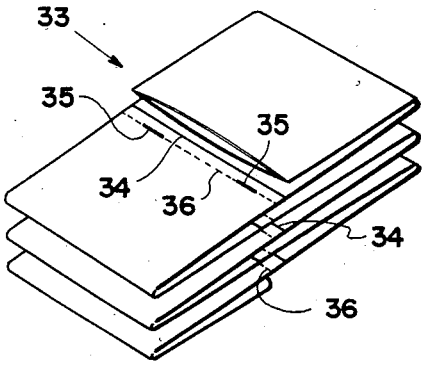
FIG. 4 is a perspective view showing the folded state of the web material.
Figure 5:
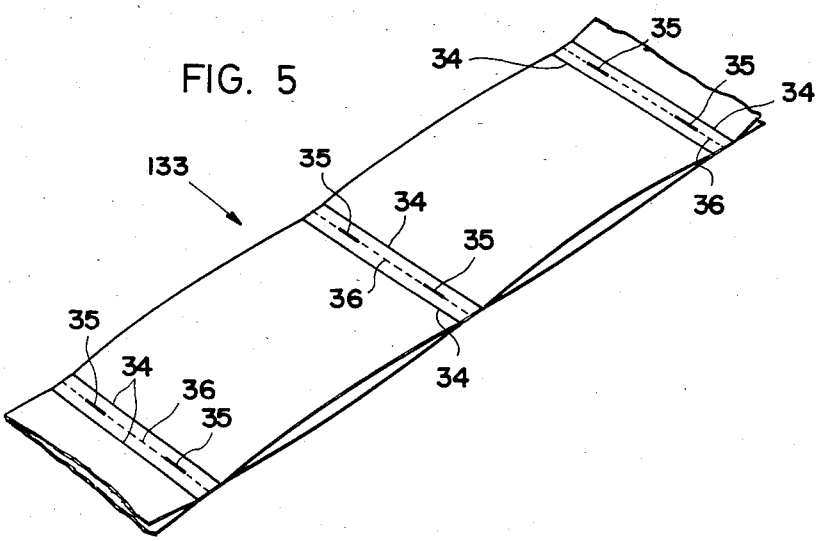
FIG. 5 is a perspective view showing a portion of another example of the web material.

FIG. 3 shows a portion of the continuous bag-shaped material 33 provided with two cuts 35 and perforated lines 36 at regular intervals and formed by means of the seal heater 29 and the cutter 30, respectively. Furthermore, this continuous bag-shaped material 33 is folded in a Z-shaped manner by the folding machine 40 so that the respective cuts 35 and perforated lines 36 can be accurately superposed on one another as shown in FIG. 4. Further, FIG. 5 shows a portion of different continuous bag-shaped material. In this case, a plastic film is folded in half in the longitudinal direction thereof to define a continuous strip of bag-shaped material 133, in which sealed portions 34 are formed on both sides of the line which includes the cuts 35 and the perforated lines 36. Openings are formed in one side edge of the film in the longitudinal direction thereof, and the folding method is similar to that of the bag-shaped material 33 shown in FIG. 3.

The continuous bag-shaped material 33 formed by the bag making machine 10 is fed to a tension adjusting mechanism 201 provided upwardly of the folding machine 40.

This tension adjusting mechanism 201 has a pair of brackets 204 which are adjustably mounted to the main frame 1 through support rods 202. A reversing roller 205 is interposed between these brackets 204 and is rotatable in a direction opposite to the direction of transferring the continuous bag-shaped material 33. The surface of this reversing roller 205 is a very smooth metal surface, so that the surface of the bag-shaped material 33 will not be damaged during reversing.

A dancer roller 206 is provided at the input side of the tension adjusting mechanism 201, whereas, a free roller 207 is provided at the output side thereof. The dancer roller 206 is supported on one end of a rocking rod 208 rockingly mounted on the bracket 204, and a balance weight 209 is mounted on the other end of the rocking rod 208 in a manner to be displaceable in the mounted position. Furthermore, a rocking scope controller 210 is provided at a predetermined position on the bracket 204 on the side adjacent the dancer roller 206, and the movement of the rocking rod 208 is adjustably controlled by means of this rocking scope controller 210.

Figure 6:
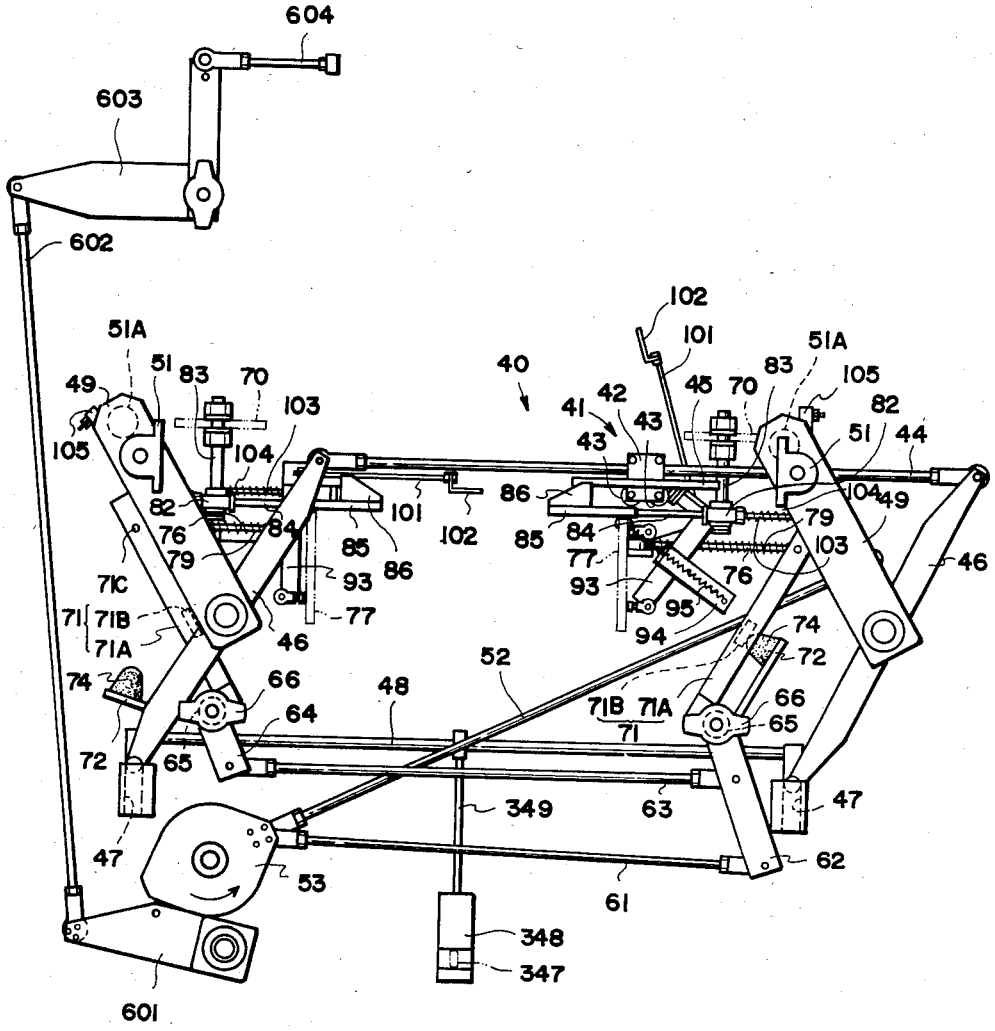
FIG. 6 is a front view of the folding machine section in the above-described embodiment.

Upon passing through the tension adjusting mechanism 201, the continuous bag-shaped material 33 is fed to the folding machine 40. As shown in FIG. 6, this folding machine 40 is provided with a bag-shaped material feed mechanism 41, which has brackets 42 and a pair of free rolls 43 supported across the brackets 42. Each free roll 43 is affixed to the longitudinally central position of an upper horizontal rod 44 through the brackets 42, and adapted to reciprocate in the horizontal direction between the folded end positions of the continuous bag-shaped material 33 along with the horizontal reciprocatory motions of this upper horizontal rod 44. Furthermore, skid-like members 45 are affixed to the outer surfaces of the brackets 42, respectively.

Figure 7:
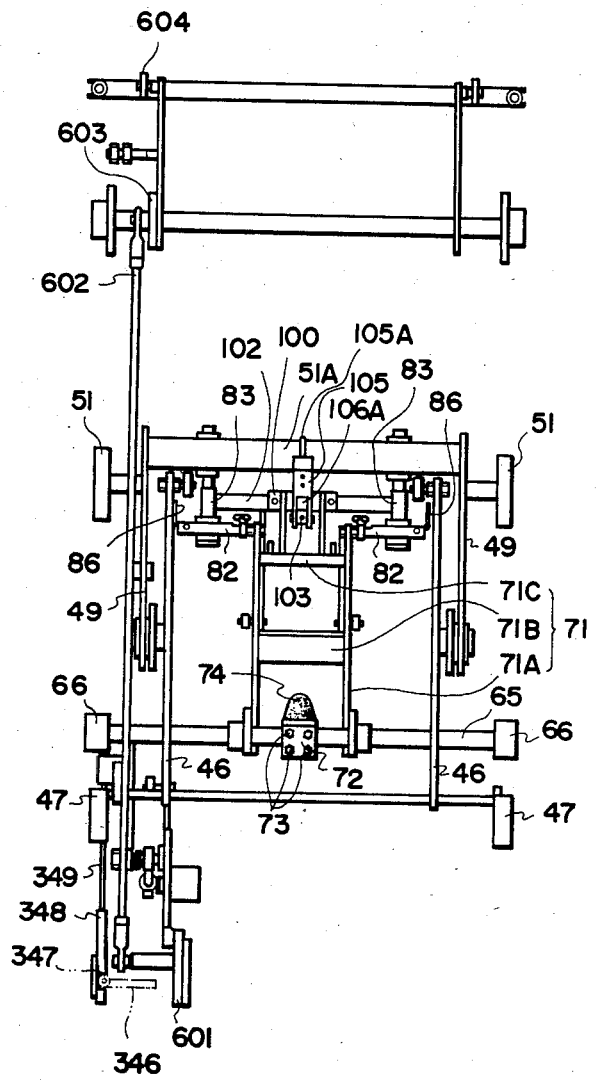
FIG. 7 is a left side view of FIG. 6.

Opposite ends of the upper horizontal rod 44 are rotatably mounted to the forward ends of rocking arms 46 shown at the right and left sides of FIG. 6, and the proximal ends of the rocking arms 46 are supported on the columnar portion 1A of the main frame 1 through vertical rails 47 so as to be rotatable and vertically movable within a predetermined range. The proximal ends of the rocking arms 46 are connected to each other through a lower horizontal rod 48 having a length equal to the upper horizontal rod 44, and the forward ends of link arms 49, each having a length of about one half the length of the rocking arm 46, are rotatably connected to the longitudinally central positions of the respective rocking arms 46. The predetermined positions of these link arms 49 at the sides of the proximal ends thereof are rotatably mounted on the columnar portion 1A of the main frame 1 through pillows 51 provided at predetermined positions substantially on the extensions of the vertical rails 47. Furthermore, connecting rods 51A shown in FIG. 7 as well are affixed to the upper ends of the link arms 49 as shown in FIG. 6.

The link arm 49 located in the upper right portion of FIG. 6 is connected to a cam member 53 disposed in the lower left portion of FIG. 6 through a first drive rod 52. When this cam member 53 is rotatably driven by a motor 55 (Refer to FIGS. 1 and 2) through a speed change gear 54, the link arm 49 rocks to the right and left in FIG. 6, whereby the upper horizontal rod 44 is reciprocated in the horizontal direction at a predetermined height, while, the lower horizontal rod 48 is reciprocated in the vertical direction within a predetermined range.

One end of a second drive rod 61 is connected to the cam member 53 at the same position as the first drive rod 52, and the other end of this second drive rod 61 is connected to a drive piece 62. Connected at a predetermined position of the drive piece 62 is the right end of a connecting rod 63 as shown in FIG. 6, and the left end of this connecting rod 63 is connected to the forward end of a connecting piece 64. The respective proximal ends of the drive piece 62 and the connecting piece 64 are affixed to rotary shafts 65 disposed in the right and left of the drawing, and these rotary shafts 65 are rotatably supported on the columnar portion 1A of the main frame 1 through pillow blocks 66 at a height equal to each other. When the cam member 53 is rotated, the drive piece 62 and the connecting piece 64 are rocked to the right and left at a cycle equal to each other, and the rotary shafts 65 affixed to the drive piece 62 and the connecting piece 64, respectively, make rotary motions in directions opposite to each other at a cycle equal to each other.

Provided at one side of the outer pripheral edge of the cam member 53 is a vertically movable arm 601 functioning as a cam follower in a manner to be constantly abutted against the outer peripheral edge of the cam member. The vertical motion of this vertically movable arm 601 is imparted to a reciprocatory rod 604 through a rod 602 and an L-shaped connecting piece 603, and this reciprocatory rod 604 is adapted to drive the slide shaft 28 of the seal mechanism 23.

Figure 8:
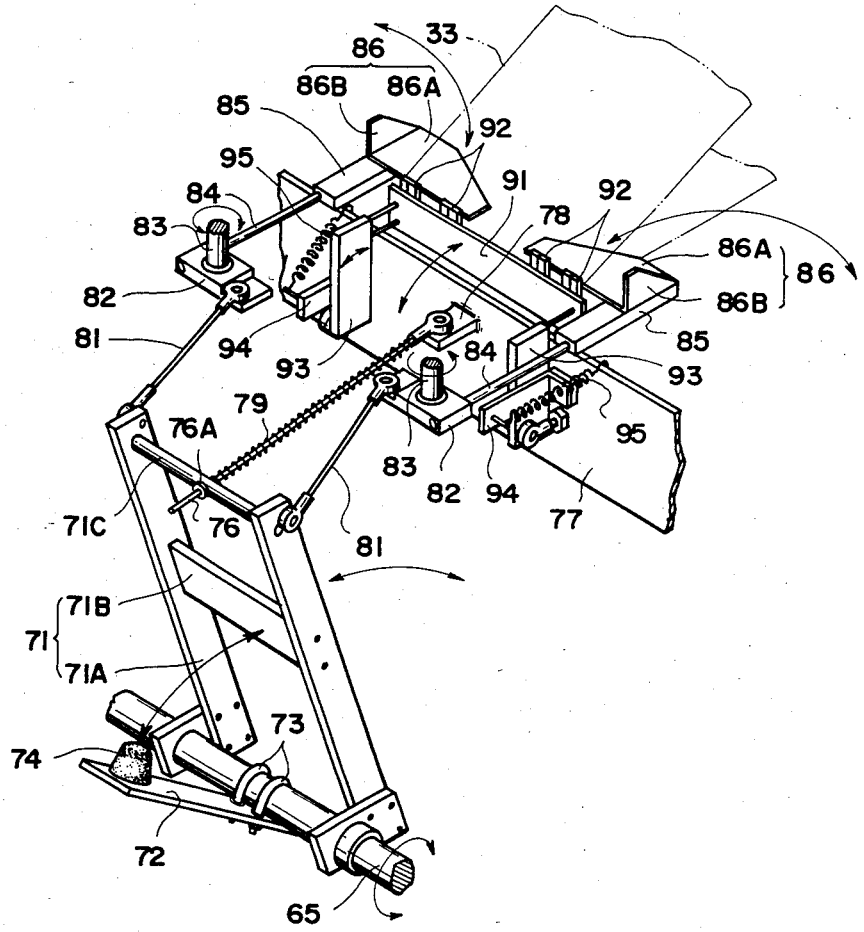
FIG. 8 is an enlarged perspective view showing the working mechanism of the openable vanes as being the folded end holding members in the above-described embodiment.

As shown in FIG. 8, rotatably mounted to the rotary shaft 65 is the lower end portions of an H-shaped rocking member 71 assembled into substantially an H shape by two legs 71A and an intermediate beam portion 71B, and an abutting piece 72 is non-rotatably affixed at the lower end thereof by means of U-shaped bolts 73 to the center between the mounting positions of the two legs 71A of the H-shaped rocking member 71. An abutting portion 74 made of a rubber piece or the like is affixed to the forward end portion of the abutting piece 72, and this abutting portion 74 is adapted to suitably abut against the aforesaid intermediate beam portion 71B as the rotary shaft 65 rotates.

In the rocking end portion of the H-shaped rocking member 71, a round rod-shaped upper beam portion 71C is rotatably racked across the two legs 71A. An end portion of an insertion rod 76 is slidably inserted through the longitudinally central portion of this upper beam portion 71C. A stopper 76A is secured to a predetermined position in the end portion, and the movement of the insertion rod 76 beyond a predetermined value to the right in FIG. 8 with respect to the upper beam portion 71C is controlled by this stopper 76A. The other end portion of the insertion rod 76 is non-rotatably connected through a projecting piece 78 onto this side surface in FIG. 8 of a stationary plate 77 affixed to a predetermined position of the columnar portion 1A of the main frame 1 in such a manner that the both side surfaces of the stationary plate 77 are incorporated in vertical planes. Furthermore, a return spring 79 is coupled onto the insertion rod 76, and, except when the abutting portion 74 of the abutting piece 72 abuts against the intermediate beam portion 71B to thereby cause the H-shaped rocking member 71 to fall down to the right in the drawing, the H-shaped rocking member 71 is restored to the position of the stopper 76A through the resiliency of the return spring 79.

Rotatably connected to the respective rocking end portions of the two legs 71A of the H-shaped rocking member 71 are one end each of two connecting rods 81 each having a predetermined length, and the other ends of these connecting rods 81 are connected to inner end portions of rotary connecting pieces 82, respectively. The rotary connecting pieces 82 are supported by vertical rotary shafts 83 suspended from support plates 70 (Refer to FIG. 6) affixed to the columnar portion 1A in a manner to be rotatable on a hypothetical horizontal plane, and the proximal end portions of the openable rods 84 are coupled and affixed to the outer end portions of the connecting pieces 82.

The forward end portions of the openable rods 84 project to the right side of the stationary plate 77 in FIG. 8. Mount portions 85, each formed into an elongate and flat rectangular parallelepiped, are coupled to the openable rods 84 in a manner to be rotatable in the circumferential directions of the openable rods 84. Openable vanes 86, functioning as the folded end holding members, are affixed to the upper end faces of these mount portions 85, respectively.

The openable vanes 86 are each formed such that one end portion of a metal sheet piece or the like having a predetermined shape is bent at a right angle. Thus, the openable vanes 86, each having a horizontal portion 86A and a vertical portion 86B, are provided at opposite sides in the widthwise direction of the continuous bag-shaped material 33. When these openable vanes 86 are in a closed state as shown in FIG. 8, the folded end portions of the bag-shaped material 33 are clampingly held by the openable vanes 86. Shock-absorbing members 92 made are provided on sponge or the like of a folded end receiving portion 91. The folded end receiving portion 91 is rockingly mounted to the stationary plate 77 through fall-down plate pieces 93, and biased to the right in FIG. 8 by means of coil springs 95 stretched between L-shaped plates 94 solidly secured to the fall-down plate piece 93 and the stationary plate 77, whereby the folded end receiving portion 91 is held in position and clampingly holds the folded end portion under a predetermined value of force in cooperation with the openable vanes 86. However, when the feed mechanism 41 abuts against the folded end receiving portion 91, the folded end receiving portion 91 is pushed in the direction of abutment to fall down (Refer to FIG. 6). When the feed mechanism 41 is retracted, the folded end receiving portion 91 is restored to the initial position by the biasing forces of the coil springs 95.

Figure 9:
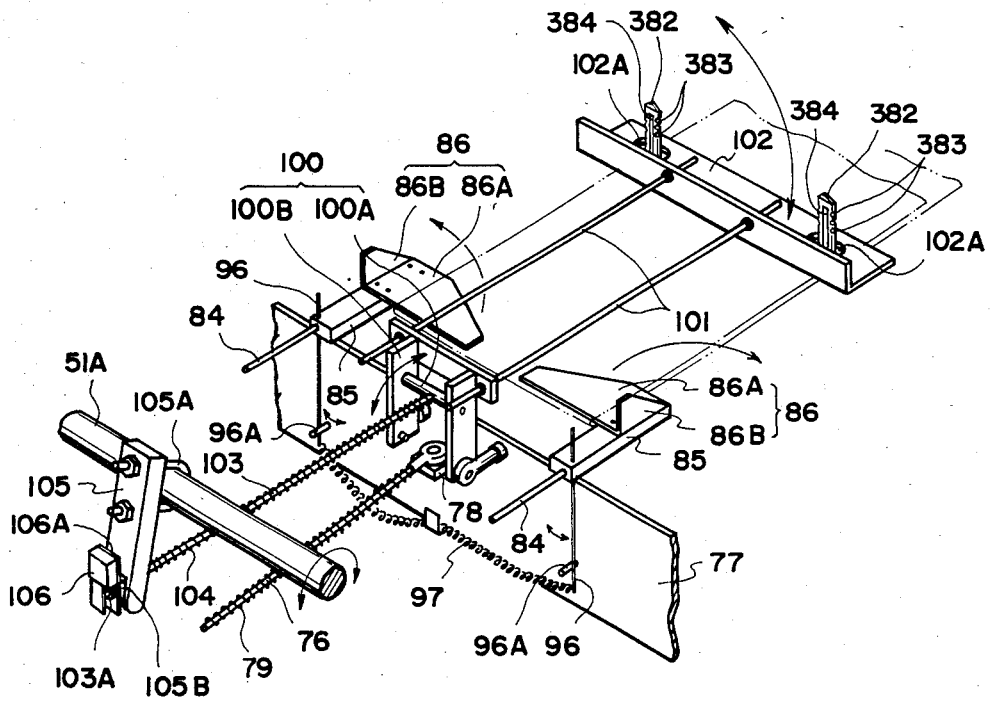
FIG. 9 is an enlarged perspective view showing the working mechanism of the retainer plate in the above-described embodiment.

The openable vanes 86 are mounted to the openable rods 84 through the mount portions 85 in a manner to be rotatable in the circumferential direction of the openable rods 84. However, as shown in FIG. 9, long pins 96 are downwardly extended through and affixed to the mount portions 85, respectively, the bottom ends of the long pins 96 are connected to each other by a long coil spring 97 having a predetermined length. The long pins 96 are biased by a comparatively weak biasing force or the weight of the spring 97 in directions in which the long pins 96 approach each other, and stoppers 96A are erected at opposite side positions on the stationary plate 77, whereby the long pins 96 are abutted against the stoppers 96A by means of the long coil spring 97, respectively, so that the horizontal portions 86A of the openable vanes 86 can be held in the horizontal direction, respectively. When the abutting portion 74 abuts against the intermediate beam portion 71B of the H-shaped rocking member 71 due to rotation of the rotary shaft 65 at a predetermined timing to cause the H-shaped rocking member 71 to fall down to the right in FIG. 8, the openable vanes 86 are opened through the rotary connecting pieces 82 and the openable rods 84. However, when the openable vanes 86 are opened beyond a predetermined degree of angle, the long pins 96 are caused to fall down to the right and left in FIG. 9 by the long coil spring 97 connecting the long pins 96 to each other, whereby the mount portions 85 are rotated about the openable rods 84, so that the forward ends of the openable vanes 86 can be elevated by a predetermined value.

As shown in FIG. 9, a retainer plate rocking member 100 assembled into substantially an H shape is rockingly mounted to the central portion of the stationary plate 77. This retainer plate rocking member 100 is provided with a retainer plate 102 having a L-shaped cross section, through retainer plate rods 101 each having a predetermined length. When the retainer plate rocking member 100 is rocked, the retainer plate 102 is rocked in the vertical direction. Furthermore, insertion holes 102A are penetratingly provided at predetermined positions in the retainer plate 102.

Figure 10:
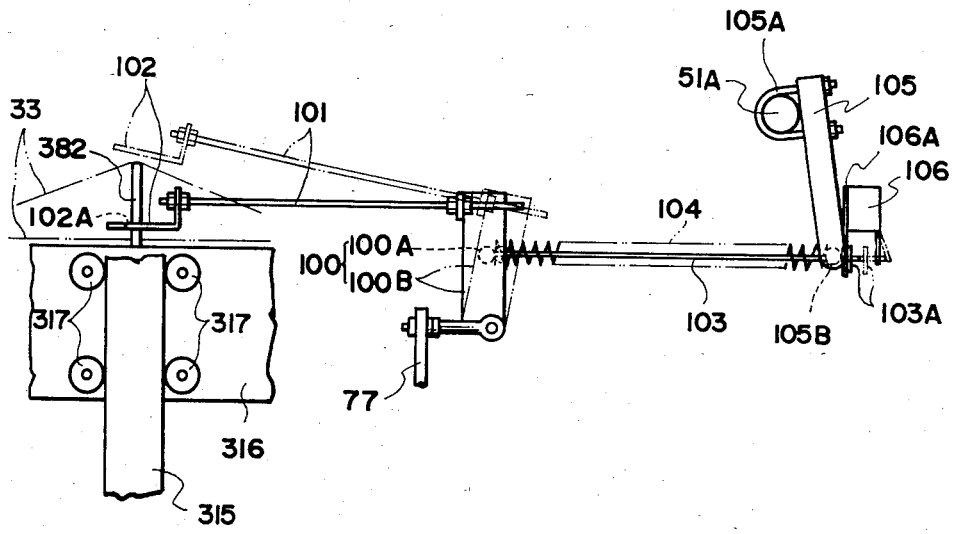
FIG. 10 is an enlarged front view showing the working principle of the automatic stop mechanism in the above-described embodiment.

An intermediate beam portion 100A of the retainer plate rocking member 100 is rotatably supported by legs 100B, and one end of a connecting rod 103 is connected to the intermediate beam portion 100A. The other end of this connecting rod 103 is connected through a connecting shaft 105B to a rocking end of a retainer plate rocking piece 105 non-rotatably secured to the connecting rod 51A through a U-shaped bolt 105A. Furthermore, a coil spring 104 is coupled onto the connecting rod 103 between the intermediate beam portion 100A and the connecting shaft 105B, and, normally, a rocking motion to the left in FIG. 10 of the retainer plate rocking piece 105 is imparted to the retainer plate rocking member 100 by this coil spring 104 to thereby lower the retainer plate 102. Whereas, a rocking motion to the right in FIG. 10 is imparted by a stopper 103A affixed to the connecting rod 103 to thereby elevate the retainer plate 102. However, if the descending motion of the retainer plate 102 is precluded due to some reason or other, then the connecting rod 103 is projected from one side surface of the retainer plate rocking piece 105, to thereby actuate a micro-switch 106 mounted to the connecting shaft 105B through a mounting plate 106A (Refer to FIG. 10). When this micro-switch 106 is actuated, a series of folding operations are automatically stopped in a state where the seal heater 29 and the cutter 30 in the seal mechanism 23 are not in abutting contact with the plastics web material 14.

A stacking machine 310 for receiving the continuous bag-shaped material 33, which has been folded by the folding machine 40, is disposed downwardly of the central portion of this folding machine 40.

Figure 11:
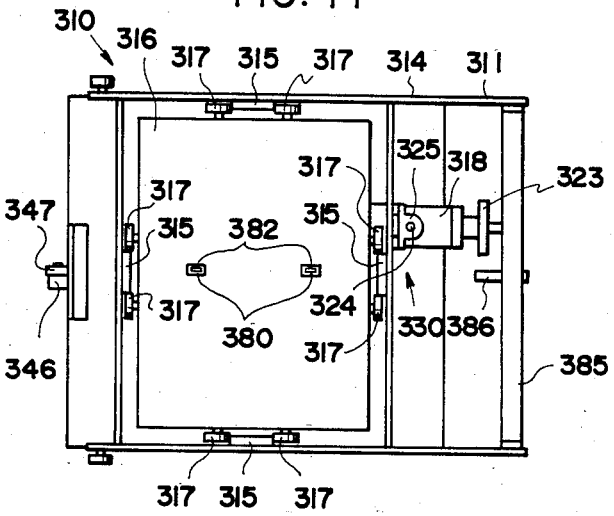
FIG. 11 is an enlarged plan view showing the stacking mechanism in the above-described embodiment.
Figure 12:
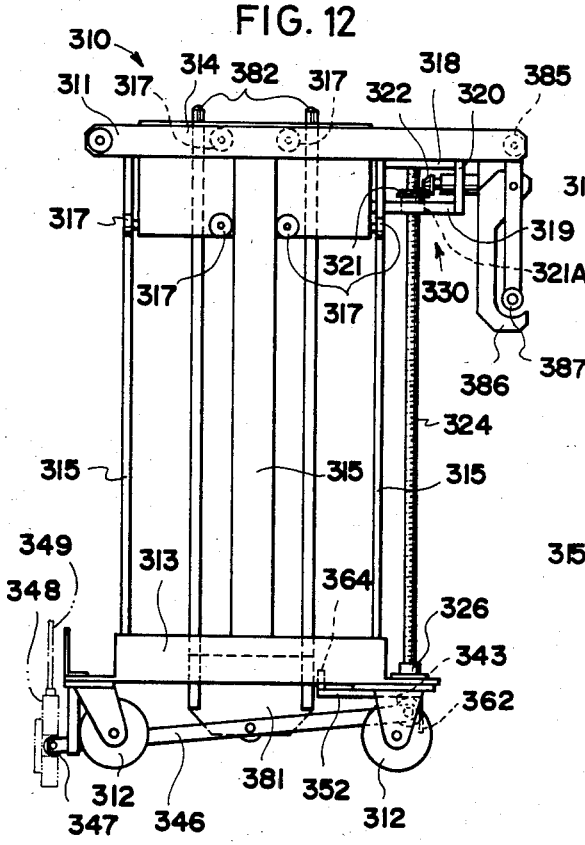
FIG. 12 is a front view of FIG. 11.
Figure 13:
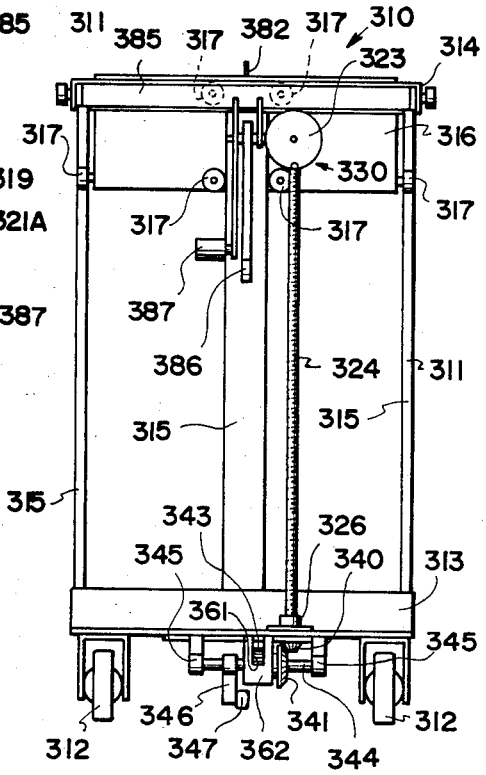
FIG. 13 is a right side view of FIG. 12.

As shown in FIGS. 11 through 13, this stacking machine 310 has a frame 311. This frame 311 includes a bottom frame 313 having a plurality of wheels 312 and a top frame 314 formed into a square frame shape, and the bottom frame 313 and the top frame 314 are connected at respective central portions of the four sides of the top frame 314 to each other by means of plate-shaped guide members 315, whereby the frame 311 is generally formed into a skeleton frame body.

A square box-shaped receiving bed 316 is provided in the frame 311 in such a manner that the receiving bed 316 is disposed in a turned-over state, with an opening thereof being directed downwardly. Two pairs of pulleys 317 are rotatably supported at upper and lower positions in the central portions of the respective side surfaces of this receiving bed 316. Each pair of pulleys 317 clampingly, slidably hold a guide member 315 from both sides thereof. The receiving bed 316 is supported by the guide members 315 through the pulleys 317 in a manner to be vertically movable with its horizontal position being maintained.

Figure 14:
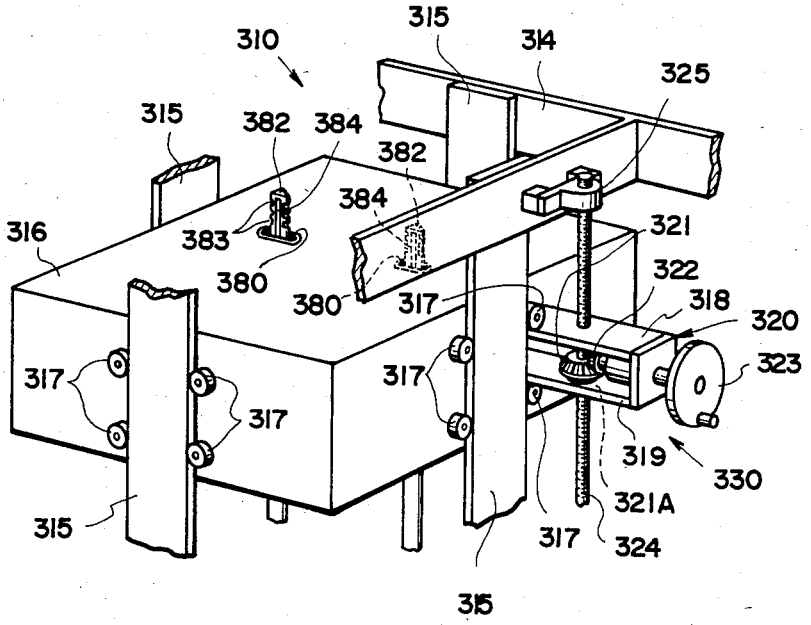
FIG. 14 is an enlarged perspective view showing the receiving bed in the stacking mechanism.

As shown in FIG. 14, an engageable member 320 having an upper plate 318 and a lower plate 319, which are spaced a predetermined distance apart from and parallel to each other, is affixed to one side surface of the receiving bed 316. A cylindrical portion 321A of an engageable bevel gear 321 having the cylindrical portion 321A is coupled into the lower plate 319 of this engageable member 320 in a manner to be rotatable but not displaceable in the axial direction of the rotation. The engageable bevel gear 321 is meshed with a driving bevel gear 322, whereby this driving bevel gear 322 is supported by the engageable member 320 and rotated by a control wheel 323.

A threaded portion is formed on the inner peripheral surface of the cylindrical portion 321A of the engageable bevel gear 321, and threadably coupled to this threaded portion is a threaded portion formed on the outer peripheral surface of a screw rod 324. The screw rod 324 is disposed in the moving direction of the receiving bed 316, i.e., the vertical direction, the upper end portion of the screw rod 324 is rotatably supported by the top frame 314 through a bearing 325, and the lower end portion of the screw rod 324 is also rotatably supported by the bottom frame 313 through a bearing 326. Here, the engageable member 320, the engageable bevel gear 321 and the screw rod 324 constitute a receiving bed moving mechanism 330.

Figure 15:
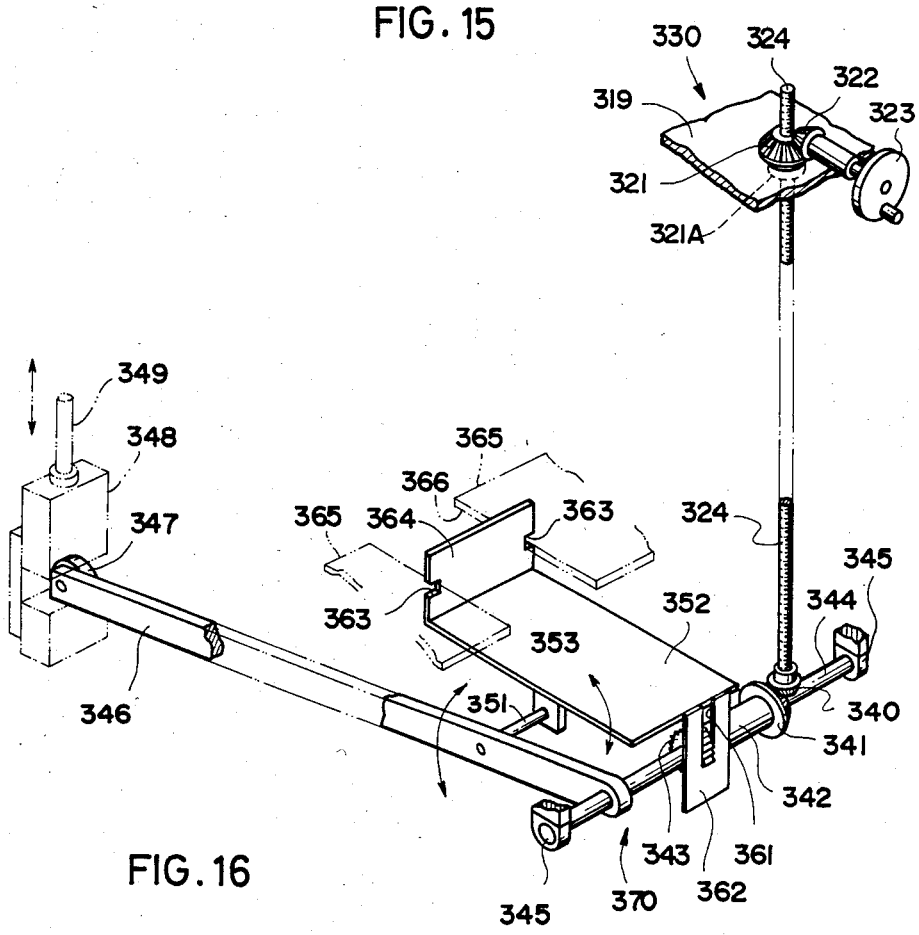
FIG. 15 is an enlarged perspective view showing the intermittent drive mechanism in the stacking mechanism.

As shown in FIG. 15, a bevel gear 340 for the bottom end is affixed to the bottom end portion of the screw rod 324, and this bevel gear 340 for the bottom end is in mesh with a connecting bevel gear 341. One end of a cylindrical rotary member 342 is affixed to this connecting bevel gear 341, and a ratchet wheel 343 is secured to the other end of the rotary member 342, whereby the connecting bevel gear 341, the rotary member 342 and the ratchet wheel 343 are integrally rotated at all times. Although the connecting bevel gear 341, the rotary member 342 and the ratchet wheel 343 are coupled onto and supported by a rotary shaft 344, these members are not affixed to the rotary shaft 344, so that these members can freely rotate about the rotary shaft 344.

The rotary shaft 344 are rotatably supported at opposite ends thereof by the bottom frame 313 through pillows 345, and the proximal end portion of a rocking shaft 346 is affixed to a predetermined position of the rotary shaft 344, whereby a rocking motion of the rocking shaft 346 causes the rotary shaft 344 to perform a rotation in the reverse direction. Furthermore, a wheel 347 is rotatably supported at a rocking end of the rocking shaft 346, and this rocking end is detachably clamped by a vertically movable connecting member 348.

The vertically movable connecting member 348 is connected to the lower horizontal rod 48 (Refer to FIG. 6) through a vertically movable rod 349. In consequence, when the vertically movable connecting member 348 is reciprocatingly, vertically moved in association with the folding operation of the folding machine 40, the vertical motions are imparted to the rotary shaft 344 through the rocking shaft 346, whereby the rotary shaft 344 is rotated, repeating rotations in the normal or reverse direction in synchronism with the folding operation.

A connecting rod 351 is rotatably, projectingly provided at a predetermined position close to the proximal end of the rocking shaft 346, and the forward end portion of this connecting rod 351 is connected to a rocking plate 352 through a projecting piece 353 projecting from the substantially central portion of the undersurface of the rocking plate 352. The rocking plate 352 formed into a rectangular plate shape is secured at a rocking end thereof with a sheet spring 362 having a cut-away portion 361 and directed downwardly. The cut-away portion 361 is adapted to be engaged with a tooth top of the ratchet wheel 343. Here, the ratchet wheel 343 and the sheet spring 362 constitute a ratchet construction. An erected plate 364, formed at opposite side edges thereof with recesses 363, is secured to the proximal end portion of the rocking plate 352 in a manner to be directed upwardly. The erected plate 364 is positioned within a gap portion 366 between bottom plates 365 provided on the bottom frame 313, and the bottom plates 365 are rockingly coupled into the recesses 363, respectively, whereby the rocking plate 352 is rockingly supported by the bottom plates 365. In addition, the rocking shaft 346, the rocking plate 352, the sheet spring 362 and the ratchet wheel 343 constitute an intermittent drive mechanism 370 for moving the receiving bed 316 only downwardly.

The proximal end portions of the two insertion members 382 are connected through a mounting plate 381 to the substantially central portion in the longitudinal direction of the rocking shaft 346 (Refer to FIG. 12). These two insertion members 382 are formed of long, flat bar-like members, and the forward end portions thereof are inserted through insertion holes 380 formed in the top end face of the receiving bed 316 and projected from the top end face. Furthermore, the two insertion members 382 are held in parallel to each other and disposed in a manner to be insertable through the cuts 35 of the bag-shaped material 33.

Figure 16:
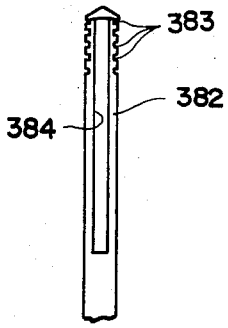
FIG. 16 is an enlarged side view showing insertion members in the stacking mechanism.

As enlargedly shown in FIG. 16, a plurality of recesses 383 are formed on the forward end portion of the insertion members 382 in the longitudinal direction and within a predetermined scope, and these recesses 383 function such that, when the continuous bag-shaped material 33 is folded on the receiving bed 316 and the insertion members 382 are inserted through the cuts 35 of the continuous bag-shaped material 33, the cuts 35 are engaged with the recesses 383, so that the bag-shaped material 33 can avoid floating up. Furthermore, a longitudinal groove 384 is formed in each of the insertion members 382 and receives therein long strip-like members such as wire-reinforced plastics tapes for bundling a predetermined number of folded sections of the continuous bag-shaped material 33.

A handle 385 for the transfer, formed of a round pipe is affixed to one side of the top frame 314 of the frame 311, and this handle 385 is operated, whereby the stocking machine 310 as a whole is moved. Furthermore, the handle 385 is mounted thereto with a hook 386 and a handle 387 for the hook. This handle 387 for the hook is operated so that the hook 386 can be detachably engaged with a horizontal bar 388 (Refer to FIG. 1) affixed across the columnar portions 1A of the main frame 1.

Referring to FIG. 1, designated at reference numeral 401 is a control box and 402 a safety frame.

Description will hereunder be given of operation of the present embodiment with reference to FIGS. 17(A) through 17(D).

In FIG. 1, an end portion of a rolled plastics web material 14 is drawn out, and passed successively through the drive rolls 18, the suspended roll 20, the guide rolls 21, the seal mechanism 23, the tension adjusting mechanism 201 and the feed mechanism 41. Thereafter, an operation is started in the condition where the web material is suspended from the feed mechanism 41 by a predetermined length downwardly, the end portion is clampingly held by either one of the both openable vanes 86 and the folded end receiving portion 91. For this, there is no need to affix the aforesaid end portion onto the receiving bed 316. When the motor 17 of the delivery mechanism 19 is operated, the plastics web material 14 is fed to the suspended roll 20, while static electricity is removed therefrom by means of a static electricity removing means, not shown. In this case, the delivery value of the plastics web material 14 is detected by the detector 22, whereby the operation of the motor 17 is controlled in response to a detection signal from the detector 22, so that the feed value of the web material 14 can be controlled. The plastics web material 14, which has passed through the suspended roll 20 and the guide rolls 21 and reached the seal mechanism 23, is subjected to the seal working and perforated line working at each predetermined distance by means of the seal mechanism 23 operated in synchronism with the operation of the folding machine 40 driven by the rotation of the cam member 53. More specifically, when the cam member 53 is rotated in the counterclockwise direction from the state shown in FIG. 6, the reciprocatory rod 604 is moved to the right and left through the rod 602 and the L-shaped connecting piece 603, whereby the slide shaft 28 of the seal mechanism 23 is moved to the right and left. By this, the web material 14 is heat-welded and sealed between the seal heater 29 and the receiving block 26, formed with the cuts 35 and the perforated lines 36 by means of the cutter 30 at the portion of the slit 25, to thereby provide the continuous bag-shaped material 33 (Refer to FIGS. 3 and 5). The delivery of the web material 14 in the portion of this seal mechanism 23 is performed in association with the operation of the bag-shaped material feed mechanism 41 of the folding machine 40. However, the tension adjusting mechanism 201 is provided between the seal mechanism 23 and the feed mechanism 41 and this tension adjusting mechanism 201 is constructed such that no tension is generated in the continuous bag-shaped material 33 on the side of the seal mechanism 23 through the agency of the reversing roller 205, so that any shift in position of the seal and the like and unsatisfactory sealing, etc. can be prevented from occurring.

Figure 17A:
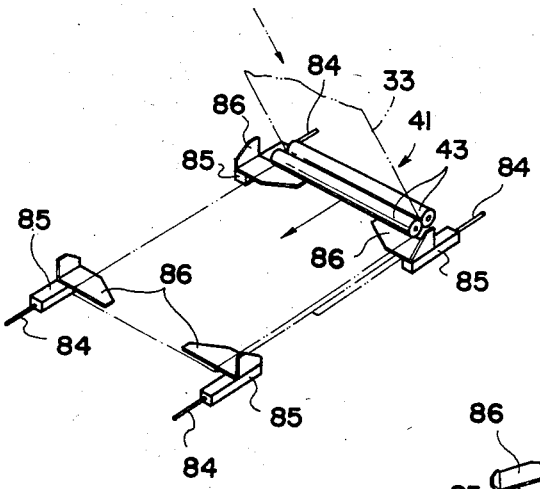
FIGS. 17(A) through 17(D) are perspective views showing the folding operation in the above-described embodiment.

Meanwhile, when the cam member 53 is positioned in the state shown in FIG. 6, the feed mechanism 41 is present at the folded end position to the right in the drawing, and FIG. 17(A) shows the operating conditions of the free rolls 43 of the feed mechanism 41 and the openable vanes 86. More specifically, in the state shown in FIG. 17(A), both openable vanes 86 located at the folded end positions at opposite sides in the drawing are closed, out of these openable vanes 86, the openable vanes 86 at the left side guide therearound the bag-shaped material 33, while, the openable vanes 86 at the right side are about to guide therearound the bag-shaped material 33. In this case, the free rolls 43 of the feed mechanism 41 are positioned by a predetermined value further to the right than the folded end position to the right in the drawing, so that the guiding of the bag-shaped material 33 around the openable vanes 86 can be easily and reliably achieved. However, the folded end receiving portion 91 for clampingly holding the folded end portion of the continuous bag-shaped material 33 in cooperation with the openable vanes 86 is adapted to be pushed by the free rolls 43 to fall down to the right in the drawing (Refer to FIG. 6), so that the free rolls 43 can avoid being obstructed in its movement by the folded end receiving portion 91.

Figure 17B:
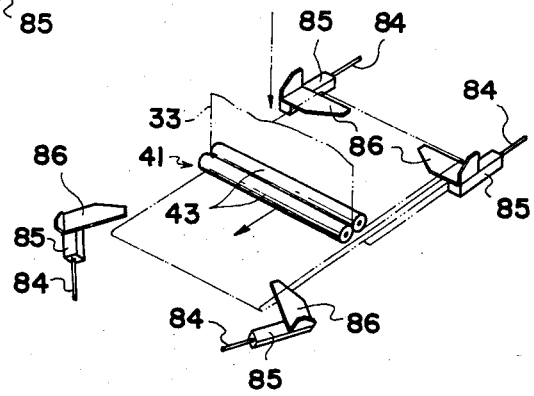

When the cam member 53 is rotated in the counterclockwise direction from the state shown in FIG. 6, the rocking arms 46 are caused to fall down to the left in the drawing through the first drive rod 52 and the link arms 49, the upper horizontal rod 44 connected to the rocking ends of the rocking arms 46 is moved to the left in the horizontal direction at the same height as before. In consequence, the feed mechanism 41 is moved leftwardly in the horizontal direction. As the feed mechanism 41 (the free rolls 43) are progressively moved to the left in the drawing due to the rotation of the cam member 53, the rotary shafts 65 are rotated in the clockwise direction in FIG. 6 through the second drive rod 61, the drive piece 62, the lateral connecting rod 63 and the connecting piece 64, and, when the abutting portion 74, to the left in the drawing, is about to abut against the intermediate beam portion 71B of the H-shaped rocking member 71, the openable vanes 86 located at the folded end portion to the left in the drawing are opened as shown in FIG. 17(B) (Refer to that indicated by chain lines in FIG. 8). Meanwhile, the retainer plate 102 to the left in FIG. 6 is pulled up due to a rotation of the connecting rod 51A of the link arm 49 in the left in the clockwise direction in the drawing through the connecting rod 103, the retainer plate rocking member 100 and the retainer plate rod 101, while, the retainer plate 102 in the right is pulled down to press down the continuous bag-shaped material 33, whereby the insertion members 382 are inserted through the cuts 35 of the bag-shaped material 33. In this case, if the insertion members 382 are not inserted through the cuts 35 of the bag-shaped material 33 for some reason or other, and the retainer plate 102 is not satisfactorily pulled down, then, as shown in FIG. 10, the micro-switch 106 is actuated by means of the connecting rod 103, whereby the folding operation is automatically stopped. In addition, the insertion members 382 are reciprocatingly, vertically moved by the rocking shaft 346 vertically movable by the vertically movable connecting member 348 connected to the lower horizontal rod 48 through the vertically movable rod 349, and moved downwardly when the feed mechanism 41 passes over the receiving bed 316, so that the reciprocatory motion of the feed mechanism 41 in the horizontal direction can avoid being obstructed by the insertion members 382.

Figure 17C:
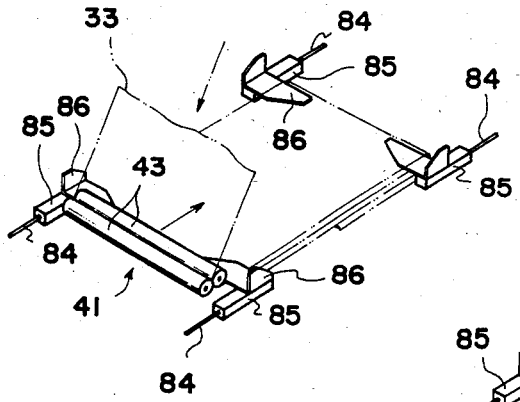

When the feed mechanism 41 (the free rolls 43) is moved further to the left in FIG. 17(B) from the state shown in the drawing and reaches a position to the extreme left as shown in FIG. 17(C), the abutting portion 74 shown in the left is separated from the H-shaped rocking member 71 due to a rotation of the rotary shaft 65 in the counterclockwise direction, and the H-shaped rocking member 71 is caused by the return spring 79 to fall down to the predetermined position to the left in the drawing, whereby the openable vanes 86 are closed (Refer to that indicated by solid lines in FIG. 8). When the openable vanes 86 in the left starts to move from a closed state shown in FIG. 17(A), passes through an opened state shown in FIG. 17(B) and reaches a closed state shown in FIG. 17(C), the forward end portions of the openable vanes 86 in the opened state are adapted to be elevate to a predetermined height by the long pins and the long coil spring 97 (Refer to FIG. 9), and moreover, the receiving bed 316 is adapted to be gradually lowered as the folding operation progresses as will be described hereunder, whereby the openable vanes 86 are reliably inserted into the continuous bag-shaped material 33 supplied anew from the free rolls 43, so that new folded end portions can be successively formed. When the free rolls 43 reach a position to the extreme left and the openable vanes 86 are closed, the forward end portions of the openable vanes 86, which have been slightly pulled up, are lowered and come in surface-to-surface contact with the continuous bag-shaped material 33. However, the vertical portions 86B of the openable vanes 86 come into abutting contact with the aforesaid skid-like members 45, so that such a disadvantage can be obviated that the forward end portions of the openable vanes 86 descend too much to excessively press down the surface of the continuous bag-shaped material 33 to thereby give damages to the aforesaid surface.

Figure 17D:
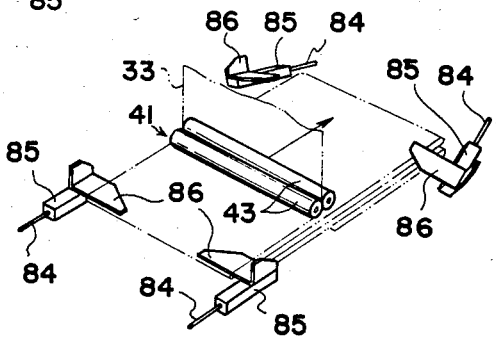

Upon reaching the position to the extreme left (Refer to FIG. 17(C)), the free rolls 43 change the course and move to the right in the drawing, guiding the continuous bag-shaped material 33 around the openable vanes 86 in a closed state (Refer to FIG. 17(D)). In this case, the folded end portion of the bag-shaped material 33 thus guided around is clampingly held between the folded end receiving portion 91 and the openable vanes 86 under a suitable clamping force by a biasing force of the coil spring 95 (Refer to FIG. 8), so that the folded continuous bag-shaped material 33, which has been stacked on the receiving bed 316, can avoid being pulled and collapsed due to a movement of the free rolls 43.

The bag-shaped material 33 is folded in a Z-shaped manner by the above-described folding operation as shown in FIG. 4 and successively piled up on the receiving bed 316. The vertically movable connecting member 348 performs only one reciprocatory motion in the vertical direction per folding action in the folding machine 40.

When the vertically movable connecting member 348 moves vertically, the rocking shaft 346 vertically rocks about a position where the rocking shaft 346 is mounted to the rotary shaft 344, the rotation of this rocking shaft 346 is imparted to the rocking plate 352 through the connecting rod 351, whereby the rocking plate 352 is rocked about the recesses 363 of the erected plate 364, so that the sheet spring 362 provided at the rocking end of the rocking plate 352 can be vertically moved.

When the sheet spring 362 is moved vertically, the cut-away portion 361 of the sheet spring 362 comes into meshing engagement with the ratchet wheel 343, whereby the ratchet wheel 343 is rotated in the counterclockwise direction in FIG. 15, whereby the rotation of this ratchet wheel 343 is imparted to the screw rod 324 through the rotary member 342, the connecting bevel gear 341 and the bevel gear 340 for the bottom end, so that the screw rod 324 can be rotated in the clockwise direction in looking from above in FIG. 15.

When the screw rod 324 is rotated, the engageable bevel gear 321 tends to rotate as well. However, this engageable bevel gear 321 is meshed with the driving bevel gear 322, and the engageable bevel gear 321 is in a locked state due to the turning frictional force of the driving bevel gear 322 and the gravity of the engageable bevel gear 321, whereby the rotation of the engageable bevel gear 321 is precluded (Additionally, in order to make this locked state reliable, an engaging fixture for suitably engaging the control wheel 323 with the engageable member 320 may be provided). In consequence, when the screw rod 324 is rotated by a predetermined degree of angle, the receiving bed 316 is moved downwardly by a predetermined value through the engageable bevel gear 321 and the engageable member 320.

Meanwhile, when the sheet spring 362 is moved downwardly, the sheet spring 362 is not brought into meshing engagement with the ratchet wheel 343, whereby the rocking motion of the rocking plate 352 is not imparted to the ratchet wheel 343, and hence, not imparted to the screw rod 324.

It has been already described that, when the folding operation is continuously performed, the vertically movable connecting member 348 performs only one reciprocatory motion in the vertical direction each time a folding motion of the folding machine 40 is made. The screw rod 324 is rotated through a predetermined angle only when the vertically movable connecting member 348 moves upwardly, whereby the receiving bed 316 is adapted to be successively lowered at a predetermined pitch with the increase in the quantity of the folded bag-shaped material 33 due to the progress of the folding operations of the receiving bed 316.

Furthermore, the insertion members 382 secured to the rocking shaft 346 (Refer to FIG. 12) vertically move in accordance with the vertical movement of the vertically movable connecting member 348, and positively thrust and inserted into the cuts 35 of the bag-shaped material 33 being piled up on the receiving bed 316. The continuous bag-shaped material 33 being successively inserted through the insertion members 382 on the receiving bed 316 is engaged with the recesses 383 of the insertion members 382 and prevented from floating up. In addition, the recesses 383 are provided on the forward end portions of the insertion members 382 only within a predetermined scope. However, the folded continuous bag-shaped material 33 on the side of the proximal ends of the insertion members 382 do not float up despite no recesses 283 are provided there because a plurality of the folded sections of the continuous bag-shaped material 33 are piled up on the top of the folded continuous bag-shaped material 33 on the side of the promixal ends of the insertion members 382.

When the receiving bed 316 is successively lowered and a predetermined quantity of the folded continuous bag-shaped material 33 is piled up on the receiving bed 316, the stacking machine 310 as a whole is removed from the main frame 1 and a predetermined sections of the folded continuous bag-shaped material 33 are to be taken out of the receiving bed 316. When this take-out is performed, the long strip-like members such as the wire-reinforced plastic tapes are inserted through the cuts 35 of the predetermined number of sections of the folded continuous bag-shaped material 33 along the grooves 384 formed in the insertion members 382, respectively, to bundle the continuous bag-shaped material 33. Thus, the predetermined number of sections of the folded continuous bag-shaped material 33 are formed to provide one unitary structure to be handled and retracted from the insertion members 382 in this state.

To set the receiving bed 316 at a desired height, the vertically movable connecting member 348 is removed from the forward end portion of the rocking shaft 346, and thereafter, the control wheel 323 is grasped and rotated, whereby the receiving bed 316 is vertically moved in accordance with the value of rotation.

The following advantages can be offered by the above-described embodiment.

The openable vanes 86 are suitably opened or closed to successively form the folded end portions, whereby the contact areas of the portions of the device with the continuous bag-shaped material 33 are reduced to an extreme extent, differing from the previous device, in which the alternately linearly movable thin sheets are used to successively fold. In consequence, such a possibility is eliminated that the continuous bag-shaped material 33 as being the web material is damaged during folding operations.

Furthermore, a series of folding motions of the operational portions actuated by the single cam member 53 are positive and reliable, and moreover, quiet because of smooth operation. Therefore, it has become possible to perform the folding motions stably and with high speed. For example, and in production, the previous device of the type wherein the alternately movable thin sheets as used for folding, about 34 sections per minute have been folded at the maximum. In contrast thereto, high speed folding of 60 sections per minute can be achieved with high stability with the inventive device.

It is needless to say the comparison with the previous device using the vacuum attraction, even if the comparison is made with the device, which has been proposed by the present inventors, wherein the alternately movable thin sheets are used, the device of this embodiment is simplified in construction, rendered compact in size and can be produced at a low cost.

The device of this embodiment is advantageous in that, as for the sealing and cut-in motions, the sealing work and the like are reliably and properly performed, because the tension adjusting mechanism 201 not generating a tension more than necessary in the continuous bag-shaped material 33 in the seal mechanism 23 portion performs the above-described motions in a condition where any excessive force is not applied at all, and, the operation of guiding the continuous bag-shaped material 33 around the openable vanes 86 can be performed reliably and properly, because a suitable value of tension is applied to the continuous bag-shaped material 33 on the side of the feed mechanism 41.

Further, when such a case occurs that the insertion members 382 have failed to be inserted through the cuts 35 of the continuous bag-shaped material 33, the microswitch 106 is actuated, whereby the folding operation as a whole is stopped in a condition where the seal heater 29 and the cutter 30 are not brought into abutting contact with the plastics web material 14 in the seal mechanism 23, so that no damages may be caused to the continuous bag-shaped material 33. In consequence, no such problem occurs that reject portions are increased in number and much trouble is needed for removing the reject portions, whereby the working efficiency is improved, and moreover, the occurrence of reject portions (portions outside the product) can be minimized, thus enabling to meet the resource-saving requirements.

Further, one of the outstanding characteristic features of this embodiment resides in that the folding machine 40 does not pile up the sections of the continuous bag-shaped material 33 by pressing down the continuous bag-shaped material 33, while, the receiving bed 316 is not lowered by being pressed, on the contrary, successively descends by itself as the folding operation progresses.

In consequence, even if a great quantity of the folded bag-shaped material 33 is piled up, there is no possibility that the piled up sections of the folded bag-shaped material collapses, so that the bag-shaped material 33 can be stably stacked. Furthermore, the sections of the folded bag-shaped material 33 on the receiving bed 316 are not pressed against and adhered to one another, whereby the bag-shaped material 33 is almost free from wrinkles and the like, the sections of the folded bag-shaped material 33 are piled up in a neat and tidy state.

In the case of the device of this embodiment, differing from the case where the bag-shaped material 33 is folded and piled up as if the bag-shaped material 33 is pressed down, the folded bag-shaped material 33 can be taken out of the receiving bed 316 as necessary during folding operation. Because of this, all the processes from the folding to the packaging of the bag-shaped material 33 are entirely automated, including automatic packaging of the folded bag-shaped material 33 by each predetermined number of sections. In this case, if a plurality of stacking machines 310 are prepared for each one folding machine 40 and the bag-shaped material 33 is successively piled up, then the all the processes from the folding to the packaging can be performed very quickly and efficiently.

Moreover, the receiving bed 316 is associated with the folding operation in the folding machine 40 such that, each time one folding motion is made, i.e., each time one section of the folded bag-shaped material 33 is piled up on the receiving bed 316, the receiving bed 316 descends by one step, so that the lowered position of the receiving bed 316 and the folded number of sections can accurately correspond to each other. Because of this, the folded number of sections can be judged from the lowered position of the receiving bed 316, and particularly, if a graduation portion is provided on the frame 311 or the like, then the folded number of sections can be readily known.

Further, the receiving bed 316 can be suitably vertically moved by means of the control wheel 323, so that take-out operation of the stacking bag-shaped material 33 and the like can be readily performed.

Furthermore, the provision of the plurality of recesses 383 at the forward end portions of the insertion members 382 can prevent the folded bag-shaped material 33 on the receiving bed 316 from floating up, thus resulting in stable stocking of the bag-shaped material 33.

Additionally, in working, the tension adjusting mechanism 201 should not necessarily be needed. However, when the tension adjusting mechanism 201 is assembled in, proper motions in the seal mechanism 23 and the folding machine 40 can be facilitated.

Figure 18A:
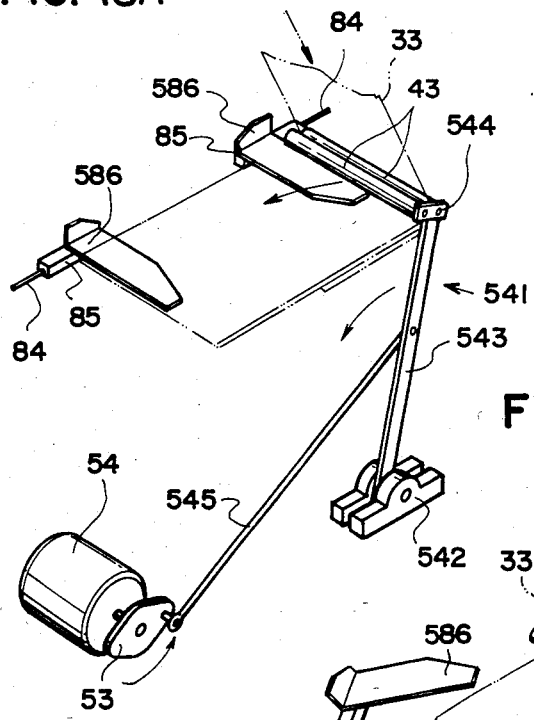
FIGS. 18(A) and 18(B) are perspective views showing the folding operation in embodiments other than the above-described one.
Figure 18B:
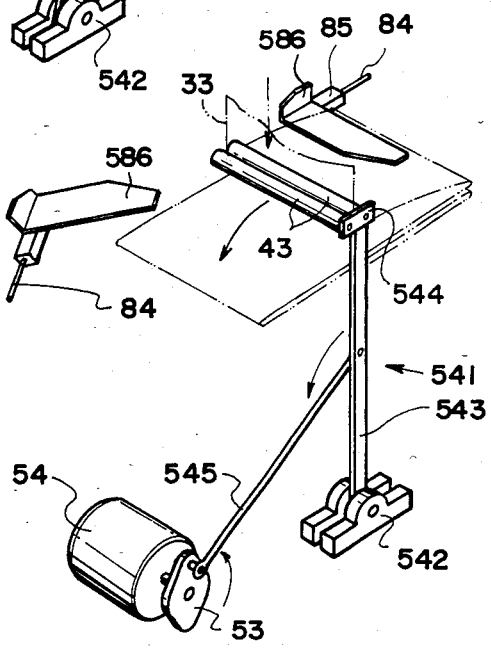

Furthermore, the feed mechanism 41 is affixed to the upper horizontal rod 44 and rectilinearly reciprocated in the horizontal direction, the feed mechanism 41 need not necessarily be limited to this specific form, but, may be replaced for example by a feed mechanism 541 adapted to reciprocate in a circularly arcuate manner as shown in FIGS. 18(A) and 18(B).

More specifically, the feed mechanism 541 shown in FIGS. 18(A) and 18(B) comprises: a rocking rod 543 rockingly mounted to a pillow block 542 affixed a predetermined distance vertically downwardly from the center position between the right and left openable vanes 86; and a pair of free rolls 43 rotatably supported on a rocking end of this rocking rod 543 in a cantilever fashion through a mounting portion 544; and is of such an arrangement that, when the rocking rod 543 connected to the cam member 53 through a driving rod 545 is rocked, the pair of free rolls 43 are reciprocated in a circularly arcuate manner between one of the folded end portions to the other of the bag-shaped material 33.

The above-described feed mechanism 541 in use is by far simplified in construction and rendered compact in size than the aforesaid feed mechanism 41. Moreover, the free rolls 43 perform motions of temporarily pressing down the continuous bag-shaped material 33 at the both folded end portions, whereby these motions are convenient to make neat and tidy the foldings of the continuous bag-shaped material 33 at the both folded end portions. Further, when the free rolls 43 pass through the central portion of the receiving bed 316, the insertion members 382 are not needed to be lowered because the free rolls 43 are at positions a predetermined distance higher than the positions when they are at the both folding end portions, and moreover, when the free rolls 43 reach one of the folded end portions, the insertion members 382 are inserted through the cuts 35. In consequence, the insertion members 382 need not be vertically moved, thus enabling to make the stacking machine 10 more simplified in construction.

Because the pair of free rolls 43 are supported in the cantilever fashion, the continuous bag-shaped material 33 can be inserted between the both free rolls 43 from the open end of the free rolls 43. In consequence, the operation at the start is further facilitated, thus improving the workability.

In addition, the pair of free rolls 43 may be supported at opposite ends thereof instead of the cantilever type, and further, the pair of free rolls may be replaced by a pair of mere rods, plates or the like.

Furthermore, in the embodiment shown in FIGS. 18(A) and (B), the openable vanes 586 are provided at one side in the widthwise direction of the bag-shaped material 33 at every opposite folded end portion. In the case of using the above-described openable vanes 586, if comparatively large (long) openable vanes are used, then the folded end portions of the bag-shaped material 33 can be reliably supported from inside and the device as a whole can be rendered more simplified in construction.

Furthermore, the openable vanes 86 or 586 need not necessarily be formed of a metal plate or the like having a predetermined shape, but, may be replaced by a rod-like member. In short, any member which can hold the folded end portion from inside will do. Additionally, the openable vane 86 or 586 rotates about the vertical rotary shaft 83 (Refer to FIG. 8) on a hypothetical horizontal plane and is linearly or rather pivotally movable toward the folded end portion, however, the folded end holding member may be one that suitably moves in a direction of the folded end edge (the widthwise direction of the bag-shaped material 33) to thereby linearly move toward the folded end position, etc.

Figure 19:
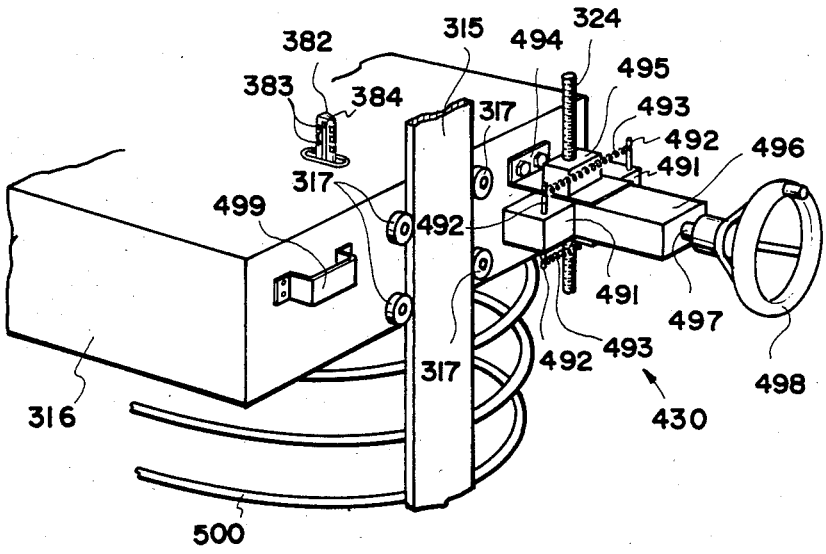
FIG. 19 is an enlarged perspective view of the essential portions of an embodiment other than the preceding ones.
Figure 20:
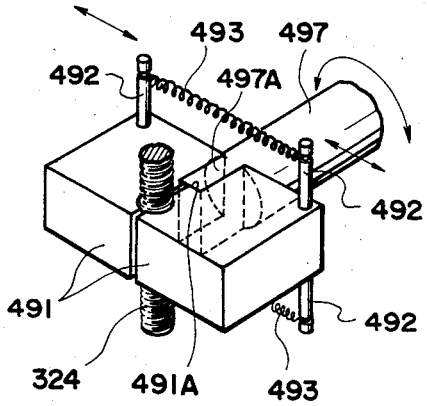
FIG. 20 is an enlarged perspective view showing the arrangement of the split nuts shown in FIG. 19.

As shown in FIGS. 19 and 20, split nuts 491 may be threadably coupled to a screw rod 324 of the stacking machine 310. More specifically, in an embodiment shown in FIGS. 19 and 20, a receiving bed moving mechanism 430 comrpises: split nuts 491 closely attached to each other by a spring 493 through pins 492 and threadably coupled to the screw rod 324 (Refer to FIG. 20); a pair of mounting plates 494 projected from one side surface of the receiving bed 316, for guiding and supporting the split nuts 491 and a bearing 495 affixed to the mounting plates 494; and a screw rod 324. Clampedly fixed between a pair of mounting plates 494 is a bearing body 496. An opening bolt 497 is coupled into and supported by this bearing body 496 in a manner to be rotatable but not allowed to fall off. As enlargedly shown in FIG. 20, the opening bolt 497 is formed at one end thereof with a small plate-shaped coupled-in portion 497A, both sides of which are shaven off. This coupled-in portion 497A is coupled into a recess 491A formed between the split nuts 491. Meanwhile, a control wheel 498 is mounted to the other end of the opening bolt 497. When this control wheel 498 is grasped and the opening bolt 497 is rotated through a predetermined value, the coupled-in portion 497A is tilted, whereby the split nuts 491 are forcedly opened against the resiliency of the spring 493, so that the screw rod 324 can be disengaged from the receiving bed 316.

The above embodiment shown in FIGS. 19 and 20 is advantageous in that the receiving bed 316 can be very quickly moved in the vertical direction, when being set at a predetermined position. Further, if a pull 499 is provided on one side surface of the receiving bed 316, the vertical operation of the receiving bed 316 can be facilitated, and, if a biasing means 500 such as a spring and the like having a suitable value of biasing force (Refer to FIG. 19) is provided at the undersurface of the receiving bed 316, it becomes convenient that, when the control wheel 498 is operated to open the split nuts 491, even if the receiving bed 316 is not supported, the receiving bed 316 can be prevented from falling by the virtue of the biasing means 500.

Figure 21:
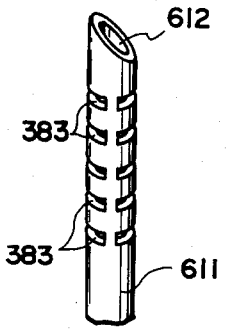
FIGS. 21, 22 and 23 are perspective views showing other examples different from one another of the insertion member.
Figure 22:
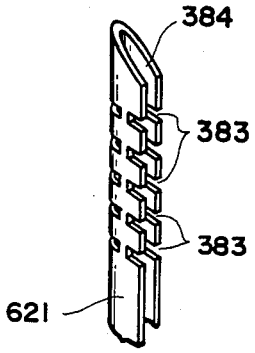
Figure 23:
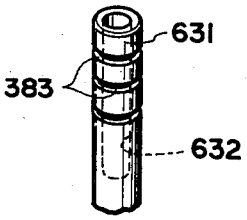

In the above-described embodiment, each of the insertion members 382 is formed of a long, flat rod-shaped member, however, this specific form may be replaced by one that is formed of a pipe-shaped member, the forward end of which is obliquely cut away to be sharpened and a hollow portion through which functions as an insertion hole portion 612 for receiving a long strip-shaped member such as a plastic tape or a cord as illustrated by an insertion member 611 shown in FIG. 21, or replaced by a rod-shaped member having a U-shaped cross section as illustrated by an insertion member 621 shown in FIG. 22. Or, a round rod-shaped insertion member 631 in which a receiving hole 632 to receive the long strip-shaped member is formed to a predetermined depth in the forward end portion as illustrated by an insertion member 631 shown in FIG. 23. In this insertion member 631 shown in FIG. 23, the forward end portion thereof is formed to provide an end face perpendicular to the longitudinal direction thereof and the peripheral edge of the end face is chamferred. Furthermore, the insertion member 631 is provided with three recesses 383, each of which is continuously formed on the entire circumference on the outer peripheral surface of the insertion member 631. Furthermore, the insertion members 382, 611, 621 and 631 need not necessarily be provided. In such a case, the bag-shaped material 33 may be folded and held in a container case or the like mounted on the receiving bed 316, for containing the bag-shaped material 33.

The aforesaid intermittent drive mechanism 370 is constituted by the sheet spring 362 and the ratchet wheel 343, however, the sheet spring 362 may be replaced by a pawl, or such a construction may be adopted that a gear incorporated in a clutch mechanism can impart rotation only in one direction.

Further, the receiving bed 316 is engaged with the screw rod 324 of the receiving bed moving mechanism 330 or 430 and successively lowered, however, this specific form may be replaced by one engaged with an endless wire, chain or the like racked across the upper and lower ends of the frame 311 and successively lowered by the rotation of the endless wire, chain or the like, or the receiving bed 316 may be provided on a pantograph shaped leg portion and made vertically movable by means of this leg portion.

Figure 24:
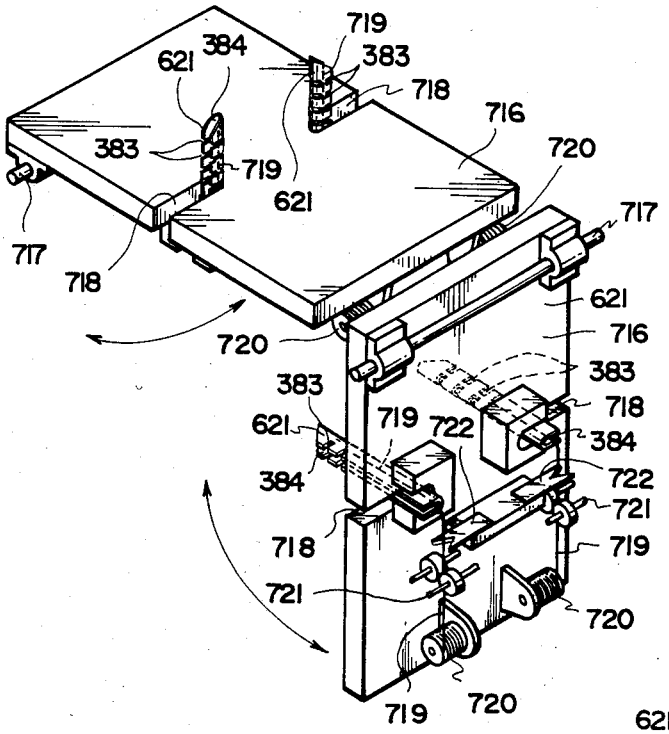
FIGS. 24 and 25 are perspective views showing the schematic arrangements of the embodiments of the stacking mechanisms other than the above and different from one another.

Furthermore, as shown in FIG. 24, two receiving beds 716 are provided on one folding machine, whereby a predetermined number of sections of the folded bag-shaped material 33 may be alternately mounted onto these receiving beds 716. In an embodiment shown in this FIG. 24, the two receiving beds 716 are each made rotatable about a rotary shaft 717, and, while the bag-shaped material 33 is being folded on one receiving bed 716, a predetermined number of sections of the bag-shaped material 33 may be removed downwardly in the drawing upon being bundled by use of the long strip-shaped member on the other receiving bed 716, and packaged into a box as they are as necessary. More specifically, the insertion members 621 (Refer to FIG. 22) are secured to these receiving beds 716, each of which is formed with a deep groove 718 communicated with the groove 384 of the insertion member 621 and opening at a side edge of the receiving bed 716. Secured to the rear surface of the receiving bed 716 are bobbins 720 repeatedly wound therearound with long strip-shaped members 719, which are fed from the bobbins 720 into the groove 384 by means of a feeding means 721 provided with a motor. Furthermore, provided on the rear surface of the receiving bed 716 are cutters 722 capable of cutting the long strip-shaped member 719 to a suitable length. In consequence, the predetermined number of sections of the bag-shaped material 33 piled up on the receiving bed 716 as they are can be bundled by use of the long strip-shaped member 719, which has been cut to a predetermined length by means of the cutters 722, and removed from the receiving bed 716 upon completion of bundling.

Figure 25:
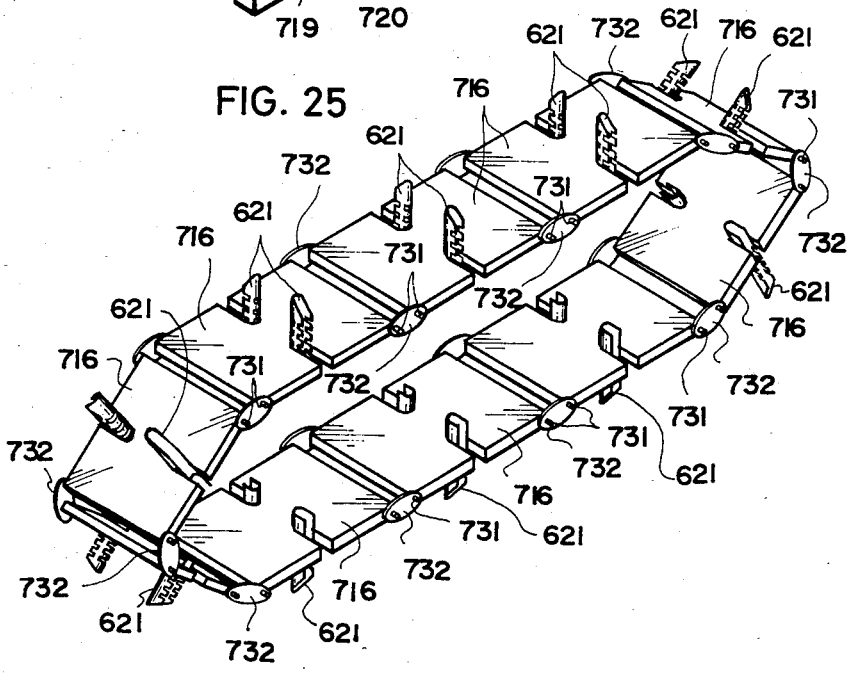

Furthermore, as shown in FIG. 25, a plurality of receiving beds, i.e., three or more receiving beds 716 may be provided. In the embodiment shown in FIG. 25, connecting pieces 732 rotatably inserted therethrough with connecting shafts 731 are secured to opposite end portions of the plurality of receiving beds 716, and the receiving beds 716 are connected to each other into an endless form as a whole through these connecting shafts 731 and the connecting pieces 732. The connecting shafts 731 are guided by means of endless rails, not shown, driven by a suitable means to be turned along the rails. The above-described embodiment is advantageous in that the work of removing the bag-shaped materials 33 piled up on the receiving beds 716 can be improved in the efficiency and the operation of packaging and the like can be further easily automated.

In the foregoing, there has been described the arrangement in which the respective mechanisms are mechanically and structurally connected to one another through the cam member 53, the arms, the rods and the like, whereby a suitable action as a whole is to be achieved through associated operations of the respective mechanisms in timing, however, this arrangement may be replaced by another arrangement in which the respective working mechanism including the seal mechanism 23, the feed mechanim 41, the openable vanes 86 of the folding machine 40, the stacking machine 310 and the like are provided with motors or cylinders, respectively, for driving the respective mechanisms, whereby these motors or cylinders are operated in association with one another through a sequence control or the like.

Further, the folded material need not necessarily be limited to the continuous bag-shaped material 33 or 133, but, may be replaced by a mere sheet-shaped web-like film or a web-like member other than the plastics film.

What is claimed is:

1. A folding device for an elongated continuous strip of plastic web material having an elongate cut formed therein at regular intervals in the longitudinal direction thereof, comprising:

frame means;

a pair of spaced end receiving members mounted on said frame means;

means defining a pathway for said web material on said frame means;

reciprocal feed means on said frame means for feeding said continuous strip of plastic web material in a zigzag manner so that web material sections are stacked one on top of the other between folded end portions thereon, said folded end portions thereon being oriented adjacent said folded end receiving members, said feed means reciprocating between said pair of spaced folded end receiving members;

folded end holding members and drive means for supporting and driving said folded end holding members for movement toward and away from said folded end receiving members along at least one lateral edge of said pathway for said web material, said drive means causing, when said folded end holding members are moved away from said folded end receiving members, said folded end holding members to move out of a previously folded end of said web material to allow passage of said feed more, said drive means causing, when said folded end holding members are moved toward said folded end receiving members, said folded end holding members to move into a location for guiding therearound said web material fed by said feed mechanism and effecting a tight clamping of said web material between said folded end holding means and said folded end receiving members; and a stacking means under said feed means having a receiving bed, onto which said folded web material is successively piled up, said receiving bed having at least one bar-like insertion member projecting therefrom and received in said linear cut formed in said web material.

2. A web material folding device as set forth in claim 1, wherein said folded end holding members are provided along opposite lateral edges of said web material and are defined by a pair of movable vanes movable toward and away from said folded end receiving members.

3. A web material folding device as set forth in claim 2, wherein said feed means and said movable vanes have a common drive means therefor.

4. A web material folding device as set forth in claim 3, wherein said feed means includes a pair of free rolls guided said web material therebetween.

5. A web material folding device as set forth in claim 1, wherein said feed means and said folded end holding member have a common drive means therefor and wherein support means are provided for said feed means to facilitate a rectilinear reciprocation thereof between said folded end members.

6. A web material folding device as set forth in claim 5, wherein said feed means includes a pair of free rolls guiding said web material therebetween.

7. A web material folding device as set forth in claim 1, wherein said feed means comprises:

a support frame;

a rocking rod supported on said support frame and having a rocking end adapted to reciprocate in a circularly arcuate manner between said folded end holding members; and a pair of free rolls mounted on a bracket secured to said rocking end of said rocking rod, said free rolls reciprocatingly moving between both said folded end holding members while guiding said web material therebetween.

8. A web material folding device as set forth in claim 7, wherein said rocking rod and said folded end holding members have a common drive means therefor.

9. A web material folding device as set forth in claim 8, wherein said pair of free rolls are supported on said bracket in a cantilever manner.

10. A web material folding device as set forth in claim 1, wherein said stacking means includes a receiving bed moving mechanism connected to said feed means through an intermittent drive mechanism adapted to impart only motions in one direction, in response to said reciprocal movement of said feed means, to said receiving bed moving mechanism to thereby move said receiving bed only downwardly.

11. A web material folding device as set forth in claim 10, wherein said receiving bed moving mechanism includes a screw rod threadably engaged with said receiving bed and disposed in the moving direction of said receiving bed; and wherein said intermittent drive mechanism has a ratchet construction for imparting rotary motions in said one direction to said screw rod.

12. A web material folding device as set forth in claim 1, wherein said stacking means includes a plurality of receiving beds.

13. A web material folding device as set forth in claim 1, wherein each said folded end receiving member includes a shock absorbing means, and wherein said web material is firmly clamped between said shock absorbing means on said folded end receiving member and said folded end holding members.

14. A folding device for an elongated continuous strip of plastic web material, said web material comprising a continuous flattened tube-shaped plastic film having a sealed segment and perforated lines partially including linear cuts a predetermined intervals in the longitudinal direction thereof, said folding device comprising:

frame means;

a pair of spaced end receiving members mounted on said frame means;

means defining a pathway for said web material on said frame means;

feed means, including a pair of free rolls supported on said frame means for reciprocating movement between said folding end receiving members, for feeding said web material in a zigzag manner so that web material secions are stacked one on top of the other between folded end portions thereon, said folded end portions thereon being oriented adjacent said folded end receiving members and with said perforated lines of said web material being exactly superposed with one another;

folded end holding means, including a pair of movable vanes provided adjacent to and on opposite lateral sides of said pathway for said web material oriented between said folded end receiving members, and drive means for moving said movable vanes horizontally toward and away from said folded end receiving members, said drive means causing, when said movable vanes are moved toward said folded end receiving members, said web material to become guided around said movable vanes and become firmly clamped between said movable vanes and said folded end receiving members;

a stacking means under said feed means for receiving successively superposed sections of said web material folded and including insert members for insertion through said linear cuts when said web material is folded; and retainer means adjacent said pathway for pressing down on said superposed web material, when said movable vanes are in the closed position so as to form a folded end, to cause said insert members to be reliably, inserted through said cuts.

15. A web material folding device as set forth in claim 14, wherein said insert members are each provided with recesses engageable with said cuts in said plastic film and further provided with a groove for receiving a long strip-shaped member to bundle said plastic film piled up and folded on said stacking means.

* * * * *

UNITED STATES PATENT AND TRADEMARK OFFICE

CERTIFICATE OF CORRECTION

PATENT NO. : 4 592 739

DATED : June 3, 1986

INVENTOR(S) : Kenji Ogawa

It is certified that error appears in the above-identified patent and that said Letters Patent is hereby corrected as shown below:

Column 20, line 66; change "more" to ---means---.

Column 21, line 23; change "guided" to ---guiding---.

Signed and Sealed this

Seventh Day of October, 1986

[SEAL]

*Attest:*

DONALD J. QUIGG

*Attesting Officer*

*Commissioner of Patents and Trademarks*